United States Patent [19]

Gunther, Jr.

[11] Patent Number: 4,946,157

[45] Date of Patent: Aug. 7, 1990

[54] SHEET LOADING AND UNLOADING MECHANISM

[75] Inventor: William H. Gunther, Jr., Mystic, Conn.

[73] Assignee: Gunther International, Ltd., Mystic, Conn.

[21] Appl. No.: 242,906

[22] Filed: Sep. 12, 1988

[51] Int. Cl.[5] ..... B65H 3/06

[52] U.S. Cl. ..... 271/163; 271/165

[58] Field of Search ..... 271/3.1, 117, 162, 163, 271/164, 157, 213, 214, 215, 217, 219, 165

[56] References Cited

U.S. PATENT DOCUMENTS 3,499,710 3/1970 Sahley ..... 271/163 X 4,365,793 12/1982 Van Blokland ..... 271/162 X

*Primary Examiner*—Richard A. Schacher

*Attorney, Agent, or Firm*—Stoll, Previto & Hoffman

[57] ABSTRACT

A mechanism for feeding sheets deposited in a container which has side walls, end walls and a bottom moveably mounted within the container on which the said sheets are deposited. An exit mouth is provided in one of the walls. The moveable bottom has slots therein and the container is provided with a flange to support the moveable bottom within the container. The container is mounted over an elevator so that the moveable bottom rests on the elevator in a raised position. The elevator and the moveable bottom which rests on it is lowered as sheets are added to the moveable bottom when the moveable bottom is lowered to the point where it rests on the support means. Feed wheels protrude through the slots in the moveable bottom and contact the lowermost sheet on the moveable bottom to move it out of the exit mouth.

2 Claims, 1 Drawing Sheet

SHEET LOADING AND UNLOADING MECHANISM

INTRODUCTION

The present invention relates to sheet loading and unloading mechanisms and more particularly to an improved sheet loader and unloader in which sheets may be unloaded from a container in the same order that they have been loaded into that same container without removing the sheets from the container.

BACKGROUND

At the present, there is an increasing need for high speed non-impact printing in order to provide the "hard copy" output of the latest technology in computer processing.

As paper for computer printing is produced in two formats, either continuous forms or sheets, manufacturers have developed printers to accommodate one or the other type of format.

When a printer operates with continuous paper forms that are attached to each other, the continuity of the printed matter remains in the proper order for post-printer processing such as mailing or binding operations. However, when printers operate with separate sheets of paper, the retention of the single sheets in their proper order with respect to one another is difficult and often impossible. One reason is that today's methods require manual handling of large stacks of paper which can easily spill or fall and get out of sequence.

There exists a number of non-impact sheet-fed printers which have one or two input hoppers which allow the printer to take individual sheets and pass them through the printing mechanism for the placement of the image onto the paper surface. Upon exiting from the printer, the sheets are placed face down into a receiving hopper or a container.

The printed sheets are delivered with the printed surface face down and, therefore, the first sheet printed must be the first sheet processed in any post-printing operation. Since the output hoppers have a limited capacity, it is necessary to continually take out small quantities of printed sheets, e.g., 500, and place them face down, on a table or pre-staging area. Because the sheets are face down, it is difficult for anyone to know exactly which group of printed sheets follow the preceding group.

In addition, there are either many small stacks of sheets or a few large stacks of sheets which can easily fall and get out of their proper sequence. In any event, intensive manual handling of sheets of paper is necessary.

One attempt to solve the above problems is the use of a container which fits into the output hoppers to accumulate the papers as they are printed and place them in containers with an upwardly moveable bottom which is capable of holding approximately 2,000 sheets. The method of collecting the paper into the container is to place the container over a narrow elevator center post and lower the box over the post so that the bottom rests on the post. As the container is filled with sheets, the elevator is lowered. Manual handling is again needed to stack the paper on tables, etc., for future processing.

BRIEF DESCRIPTION OF THE INVENTION

The present invention eliminates these problems and provides an improved mechanism which eliminates the necessity of manual handling of sheets from the print station until they are fed automatically into post-printing machinery.

A container, preferably made out of plastic, is provided with a separate central upwardly moveable bottom piece which is placed into the box and rests at the bottom on an inwardly extending flange at the bottom of the box. The bottom piece supports the paper sheets as they are fed into the container from the printer.

The container is placed over an elevator which engages the moveable bottom piece and raises it off the retaining flange to its upmost position. In this position, the bottom piece rests on the elevator. As the printer produces printed sheets of paper, they will be delivered into the container and will lay and stack on top of the raised bottom center piece. As the number of sheets increases, the elevator will descend and the bottom center piece will continue to travel downwardly to its lowermost position. When the container is filled, the printer automatically shifts to its next position where there would be a second empty container waiting for paper. The filled container will hold approximately 2,000 sheets of paper in proper sequence and can now be taken to another piece of equipment which will be called hereinafter a Pre-Loader for identification purposes only.

The bottom piece has a plurality of holes cut into it which will allow friction feed wheels from a feeding device (which is described hereinafter in greater detail) to protrude into the container and which will feed sheets of paper into another processing mechanism for other possible functions to be performed thereon. The lower edges of a side wall of the container has an exit mouth therein which will allow sheets to be fed out of the bottom from its lowermost point.

The Pre-Loader comprises inter alia, a plurality of friction drive wheels. The filled container is placed on the Pre-Loader in such a position that the feed wheels will protrude through the bottom center section of the container at the points where the sections have been cut out of the bottom to form holes. The wheels are rotated and will come in contact with the lowermost sheet of paper (which was the first sheet printed) and will feed that sheet as well as all other sheets from the bottom up.

The Pre-Loader device may be attached to a Precise Single Sheet Feeder which feeds the sheets one-by-one into a final post-processing machinery. Such Precise Feeders have an optimum amount of paper placed into them in order to obtain the optimum single sheet feeding rate without encountering problems of doubles or misfeeds. The Precise Sheet Feeder has sensing means which will be used to activate the Pre-Loader to either feed or stop feeding sheets. If, for example, it is found that two inches of paper is the optimum desired amount of paper for the precise feeding, the sensing means activates when the stack of paper reaches a minimum of 1.5 inches or a maximum of 2.5 inches. When the sensing means senses a minimum stack, the Pre-Loader motor is activated to drive the wheels protruding into the box and start feeding paper into the precise feeder. When the sensing means senses a maximum stack, the Pre-Loader is stopped and feeding of paper from the box is stopped.

DESCRIPTION OF INVENTION

Figure 1:
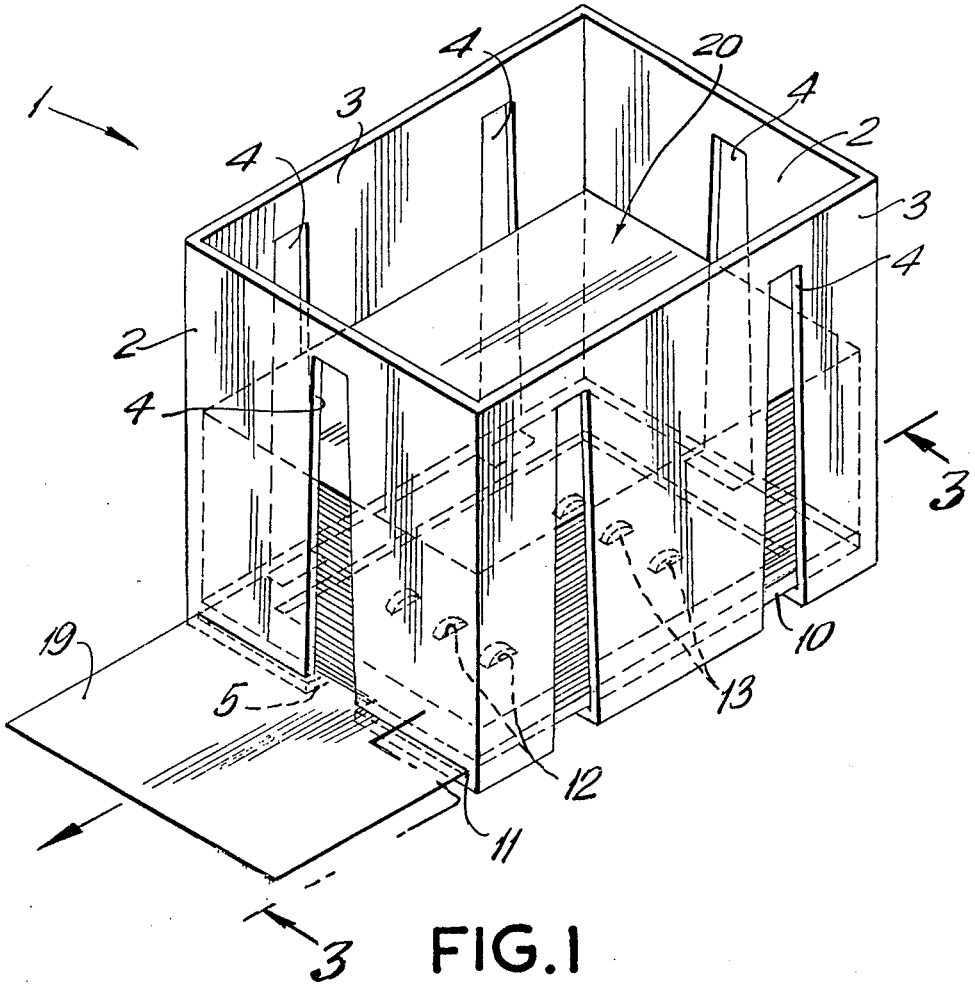
FIG. 1 is a perspective view showing the container of the invention in operation.

Referring more particularly to the drawings, the present invention comprises a container 1 which is preferably made of a light plastic. It comprises a pair of opposed end walls 2 and a pair of opposed side walls 3. Elongated openings 4 are provided in the end walls 2 and side walls 3. The lower edge of the side walls 3 and end walls 2 are provided with an inwardly extending flange 5 which may be continuously circumferential or discontinuously on portions of the lower walls 2 and 3. A movable bottom 10 rests on the flange 5 and is adapted to be moved vertically within the container 1, as will be set forth in greater detail hereinbelow.

One of the end walls 2 has an exit mouth 11 on its lower edge. This will permit individual sheets 19 to be withdrawn from the bottom of a stack 20 of sheets through the exit mouth 11. The exit mouth 11 is at the same level as and exposed by the moveable bottom 10 when the bottom 10 is resting on the flange 5 so that the lowermost sheet 19 in a stack 20 of sheets can be easily moved out through the exit mouth 11.

The moveable bottom 10 is provided with a plurality of slots 12 which are adapted to accommodate feed wheels 13 from a Pre-Loader mechanism (not shown). The feed wheels 13 are adapted to grasp the lowermost sheet 19 in a stack 20 and move it out through the exit mouth 11.

Figure 2:
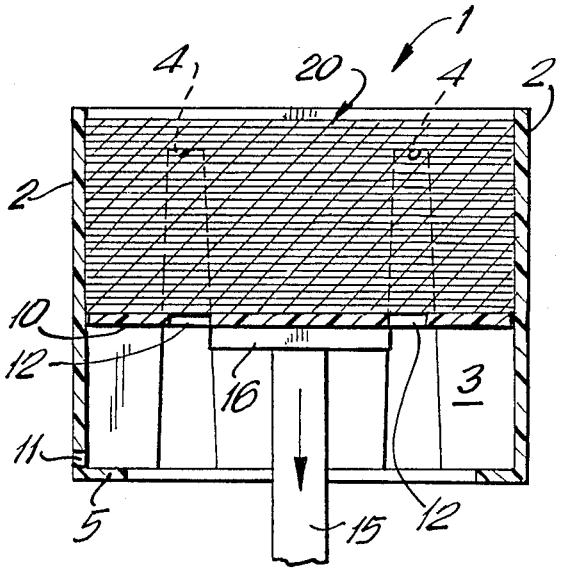
FIG. 2 is a sectional view showing the container of the present invention being loaded.

In operation an empty container 1 with the moveable bottom 10 in its lowermost position resting on the flange 5 is positioned at a Printer Station (not shown) which includes an elevator 15 with an upper platform 16 as shown in FIG. 2. The empty container 1 is placed over the elevator 15 so that the elevator 15 strikes the moveable bottom 10. As the container is lowered thereover, the moveable bottom 10 is raised toward the top of the container 1 by the elevator 15.

In this position, the Printer will start feeding printed sheets 19 one-by-one on to the raised moveable bottom 10. As each sheet 19 is fed, the elevator (as well as the moveable bottom 10 it supports) will be lowered slightly. As the sheets 19 continue to be fed and accumulated in a stack 20 on top of the bottom 10 within the container, the elevator 15 reaches its lowermost position and the bottom 10 reaches the flange 5 and rests thereon. A sufficient number of sheets 19 have been fed by the Printer and have accumulated in a stack 20.

Figure 3:
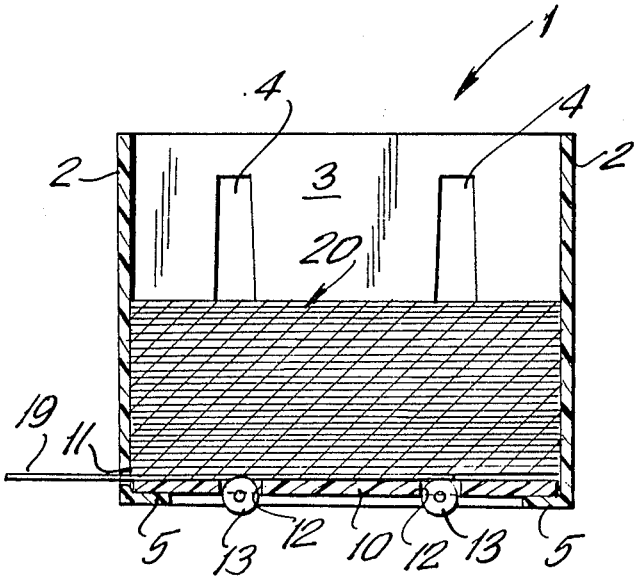
FIG. 3 is a perspective view taken along line 3—3 of FIG. 2.

At this point, the container 1 is removed from the Printer Station and placed, as shown in FIG. 3, on the Pre-Loader Station which consists of a plurality of feed rollers 13 over which the filled container 1 is placed. As shown in FIGS. 1 and 3, the feed rollers 13 protrude through the openings 12 in the moveable bottom 10 and strike the lowermost sheet 19. When the feed rollers 13 are rotated, the lowermost sheet 19 is moved out of the container 1 through the bottom exit mouth 11.

It will be noted that the sheets 19 are removed from the container 1 in the same order as they are placed into the container. This is done without the necessity of removing any of the sheets 19 from the container 10 so that there is no danger that the order of the sheets 19 will be disturbed. Since there is no manual handling of the sheets 19 the sheets 19 are fed out of the container 1 in the same order that they were fed into the container 1.

With this method of handling the output from sheet-fed printer, it is now possible to have complete control of the paper from the moment it is printed through the final post-processing operation without ever having to manually handle individual stacks of paper. The paper can never get out of print sequence and the existing labor intensive method of handling thousands of sheets of paper per day is eliminated.

Having thus described the invention it is claimed:

1. A container comprising end walls, each of said walls having upper and lower edges, a bottom movably mounted within said container, an exit mouth in one of said walls and said movable bottom having slots therein, means in the container to support said movable bottom within the container at a level adjacent the said exit mouth, said support means comprising flange means extending inwardly from at least some of said walls, the upper surface of said movable bottom being substantially on the same plane as the exit mouth when the movable bottom is in its lowermost position.

2. A container set forth in claim 1 wherein said exit mouth and said flange means are adjacent the lower edges of said walls.

* * * * *